United States Patent [19]

Watts

[11] 4,074,919

[45] Feb. 21, 1978

[54] CHAIR FRAME FURNITURE UNIT

[76] Inventor: William R. Watts, Rte. No. 1, Box 320-1, Millsboro, Del. 19966

[21] Appl. No.: 608,047

[22] Filed: Aug. 27, 1975

[51] Int. Cl.[2] ..... A47C 15/00

[52] U.S. Cl. ..... 297/233; 297/440

[58] Field of Search ..... 297/233, 252, 440, 450, 297/459, 443, 231, 232, 445, 223

[56] References Cited

U.S. PATENT DOCUMENTS

| | | | |
|---|---|---|---|
| 2,466,204 | 4/1949 | Brown | 297/440 X |
| 2,678,088 | 5/1954 | Jamison, Jr. | 297/440 |
| 3,034,844 | 5/1962 | Anderson et al. | 312/195 X |
| 3,104,913 | 9/1963 | Faulkner et al. | 297/440 X |
| 3,170,729 | 2/1965 | Grant | 297/440 |
| 3,414,912 | 12/1968 | Dusey, Sr. et al. | 297/445 |
| 3,874,729 | 4/1975 | Blodee | 297/445 |

FOREIGN PATENT DOCUMENTS

| | | | |
|---|---|---|---|
| 239,819 | 8/1960 | Australia | 297/445 |
| 293,977 | 3/1932 | Italy | 297/445 |
| 6,712,440 | 3/1969 | Netherlands | 297/440 |
| 474,624 | 11/1937 | United Kingdom | 297/445 |
| 1,189,766 | 4/1970 | United Kingdom | 297/232 |

*Primary Examiner*—James T. McCall

[57] ABSTRACT

Disclosed is a chair frame unit adaptable to provide sectional furniture comprising a solid base having a solid type seat sectional frame resting upon it, a back frame unit resting atop the seat sectional frame and arm frames are arranged to rest atop the base unit adjacent to the side portions of the seat section and against the side portions of the back frame. The units are readily adaptable to be rigidly affixed to one another to form sofas comprising a number of the units in alignment.

5 Claims, 7 Drawing Figures

CHAIR FRAME FURNITURE UNIT

BACKGROUND OF THE INVENTION

This invention relates to a chair frame unit and more particularly it relates to such units that are readily adaptable to be rigidly affixed to each other to form sofas or different lengths as well as useful single chair units. The chair frame unit of this invention is particularly useful for institutional use requiring high durability and strength.

SUMMARY OF THE INVENTION

The invention in its broader aspects is defined as a chair frame unit adaptable to provide sectional furniture comprising:

a. a base of substantial thickness adapted to support a seat section frame, a back frame, and at least one arm frame, and function as legs to provide high rigidity and strength to the unit, said base comprising a front beam, a rear beam, and two side beams arranged in a rectangular array rigidly connected at each of four corners;

b. a seat section frame of substantial thickness arranged and adapted to rest upon and rigidly affixed to the base and further adapted to support seat cushioning means, said seat section comprising a front beam, back beam, and two side beams, at least one of the seat section side beams being disposed inwardly with respect to the base side beam below it in an amount sufficient to allow an arm frame to rest atop the base and be in substantial vertical alignment with the side beam of said base while being arranged adjacent to and against the inwardly disposed seat section side beam;

c. a back frame adapted to receive back cushioning means and further adapted to rest on top of said seat section rear beam with the exterior portions of said back frame being in substantial vertical alignment with the exterior portion of the seat section side beams, said back frame comprising a bottom member, a top member, and two side members rigidly connected to each other at their corners to form a rectangular array, said back frame being rigidly affixed to the seat section frame; and d. at least one arm frame comprised of a top member, bottom member, and two end members rigidly affixed to each other at corners to provide a rectangular array, said arm frame being adapted and disposed to rest atop the base in substantial vertical alignment with the exterior portion of the side beam of the base located below the arm frame and against the exterior portion of the adjacent side beam of the seat section frame, said arm frame having means for rigidly affixing said arm frame to the seat section frame and the back frame.

Also within the scope of this invention is the chair unit as above defined having two arm frames in (d) to provide a unit that is useful as a chair. Another aspect of the invention involves the chair frame unit as above defined wherein in (b) the front beam of the seat section frame is located and disposed to extend beyond the front beam of the base located below to provide an overhang.

It is also desirable for some uses that the chair unit have only one arm frame in (d) and in (b) one of the side beams of the seat section is in substantial vertical alignment with the side beam of the base located below. Such a unit is readily adaptable to be bolted or rigidly attached in substantial alignment with a similar unit having an arm located on the opposite side to provide a sofa. If desired, additional units having no arms but having the side beams of the base and the seat section frame in alignment can be bolted intermediate of the end units to provide sofas of various multiple lengths.

DETAILED DESCRIPTION OF THE INVENTION

Figure 1:
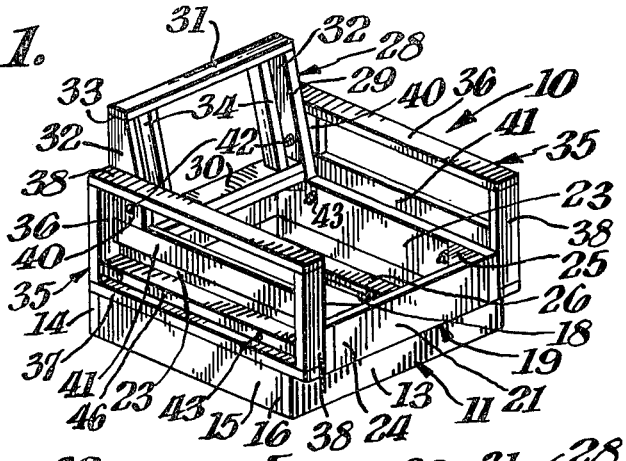
FIG. 1 is a perspective view of a chair frame unit of this invention having two arm frames to serve as a single chair unit.
Figure 2:
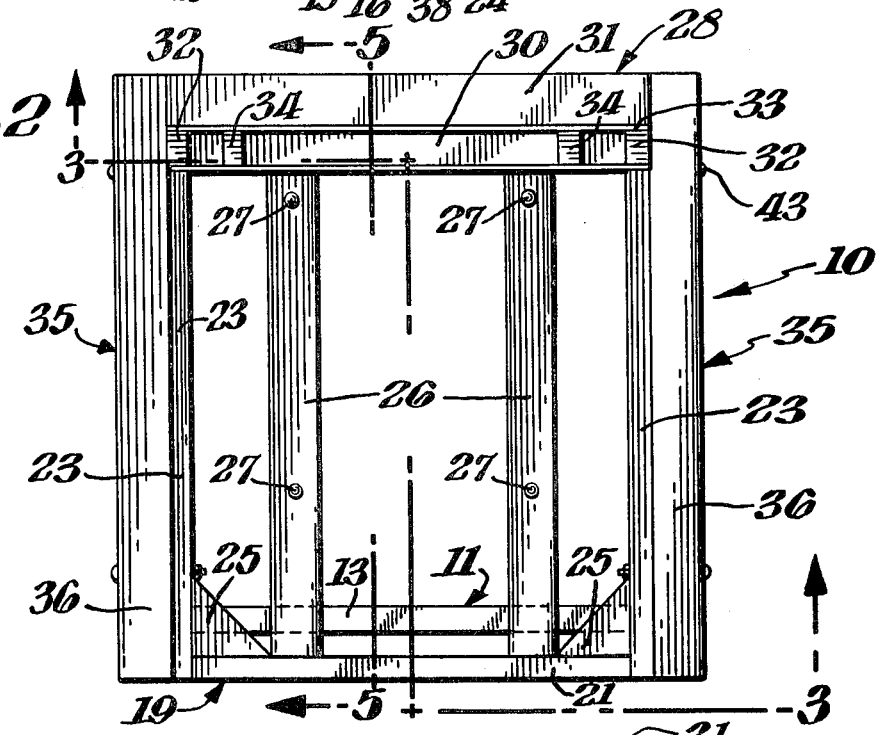
FIG. 2 is a top plane view of the chair frame unit shown in FIG. 1.
Figure 3:
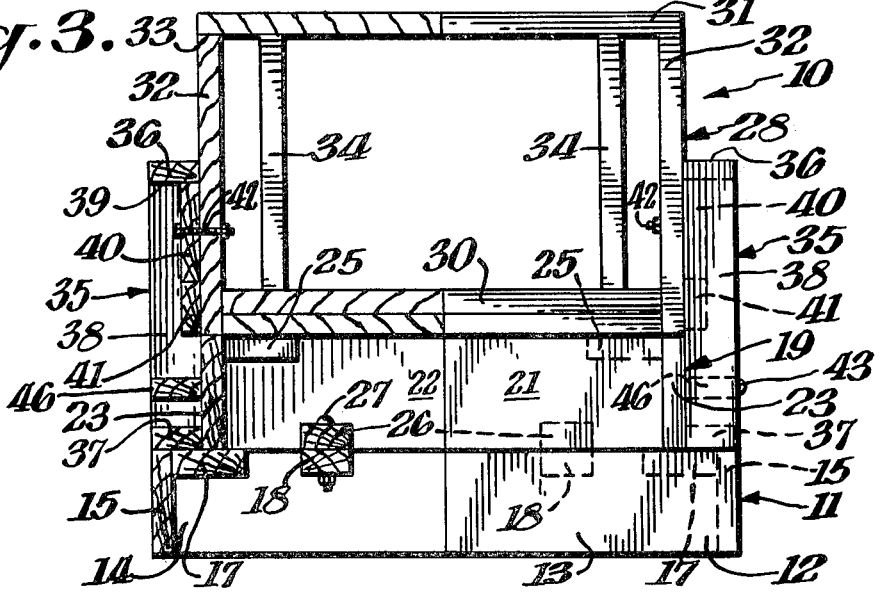
FIG. 3 is a partial front cross-sectional view taken along line 3—3 in FIG. 2.
Figure 4:
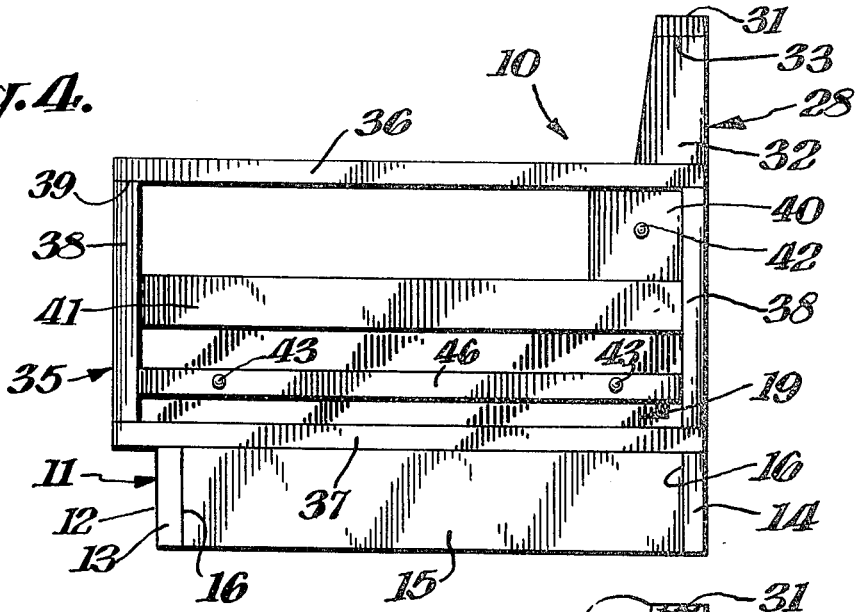
FIG. 4 is a side elevational view of the chair frame unit shown in FIG. 1.
Figure 5:
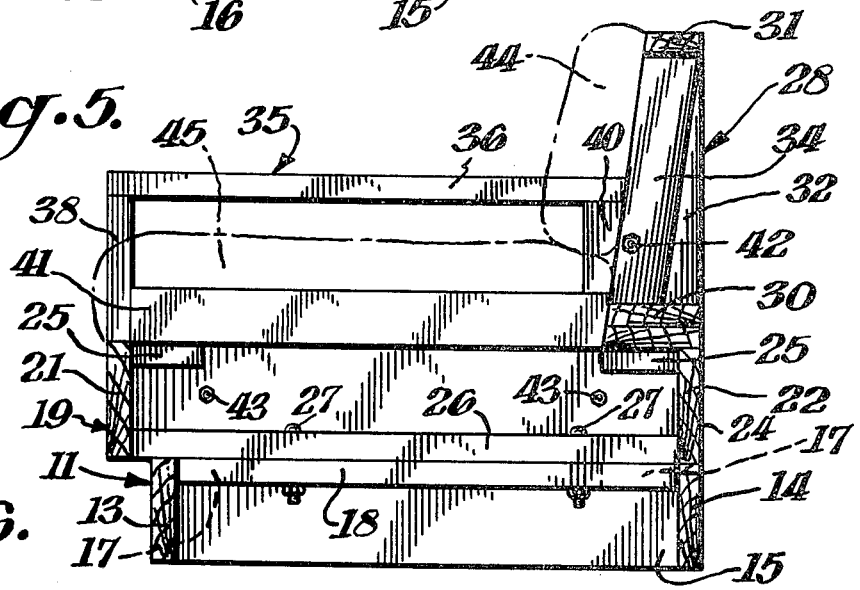
FIG. 5 is a cross-sectional view along line 5—5 of FIG. 2.

Throughout the drawings like numerals refer to identical parts. With reference to the drawings the chair frame unit of this invention is depicted as 10. As illustrated in the drawings, base 11 having a substantial thickness 12 is comprised of front beam 13, rear beam 14, and two side beams 15. The four beams are arranged in a rectangular array and rigidly connected to each other at corners 16. For added rigidity, it is desirable to have braces 17 that are right triangular in shape located in the uppermost corners of the interior proportion of the base 11. Interior cross members 18 are located within the base and extend from front beam 13 to rear beam 14 with the cross members being located at the uppermost portion of the base 11.

The seat section frame 19 is likewise of a substantial thickness 20 and is comprised of front beam 21, rear beam 22, and two side beams 23 having exterior portions 24. The beams are again arranged in a rectangular array and rigidly affixed to each other at the corners. For added rigity it is desirable to have right triangular bases 25 located in the upper corner portions within the interior of the seat section frame 19. The interior cross members 26 extend from the front beam 21 to the rear beam 22 of the seat sectional frame 19 and cross members 26 are in substantial alignment with the cross members 18 of the base located beneath. Such alignment is desirable as it facilitates bolting the base to the seat section frame. Such securing means or bolts 27 are illustrated.

Back frame 28 is adapted to receive back cushioning means 44 and has exterior portion 29. The back frame 28 is comprised of bottom member 30, top member 31, and two side members 32. The members are rigidly connected at corners 33. In addition, interior vertical members 34 are provided for added structural rigidity, strength and support.

The arm frame 35 is comprised of top member 36, bottom member 37, and two end members 38 connected together rigidly at corners 39. Corner blocks 40 are useful for added rigidity and for providing and facilitating attachment of arm frame 35 to the back frame 28. Interior cross members 41 extend horizontally between the end members for added rigidity and strength and to form a receptacle for seat cushioning means 45.

Bolts 42 or means for attachment of arm frame 35 to the back frame 28 are illustrated. The bolts 43 or means for attaching the arm frame 35 to the seat section frame 19 are illustrated. Bolts 43 pass through horizontal members 46 disposed within arm frame 35.

Figure 6:
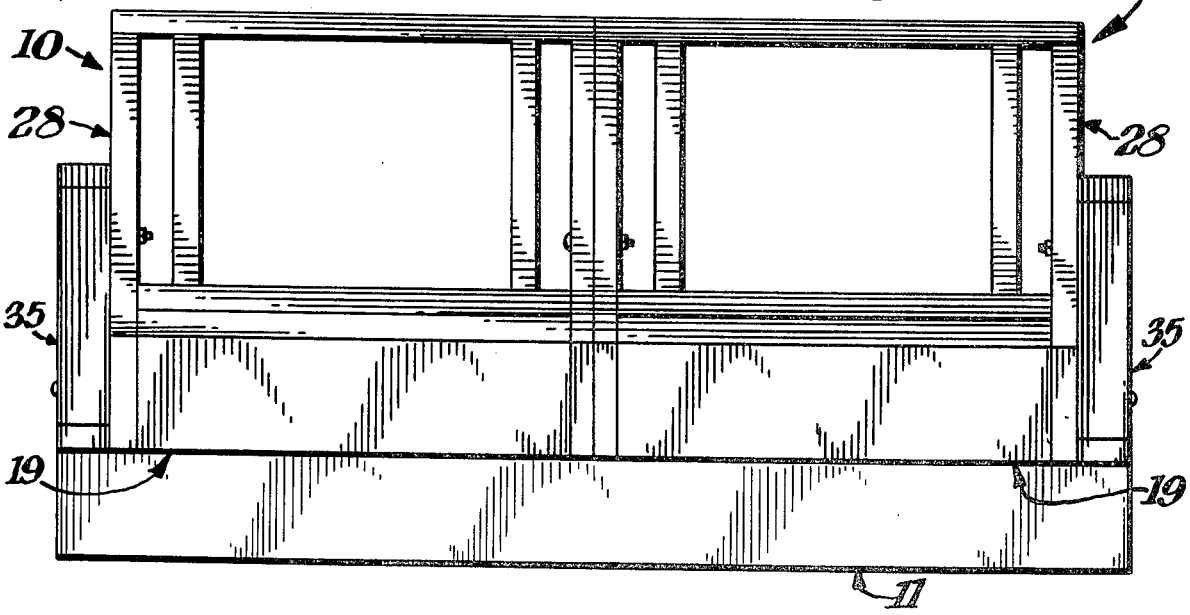
FIG. 6 is a front elevational view showing an alternate assembly of the modular components of the chair frame unit of this invention to form a sofa. In this embodiment each chair unit has only one arm frame and at the opposite end of the unit the side beams of the base member and the seat section frame are in substantial vertical alignment.
Figure 7:
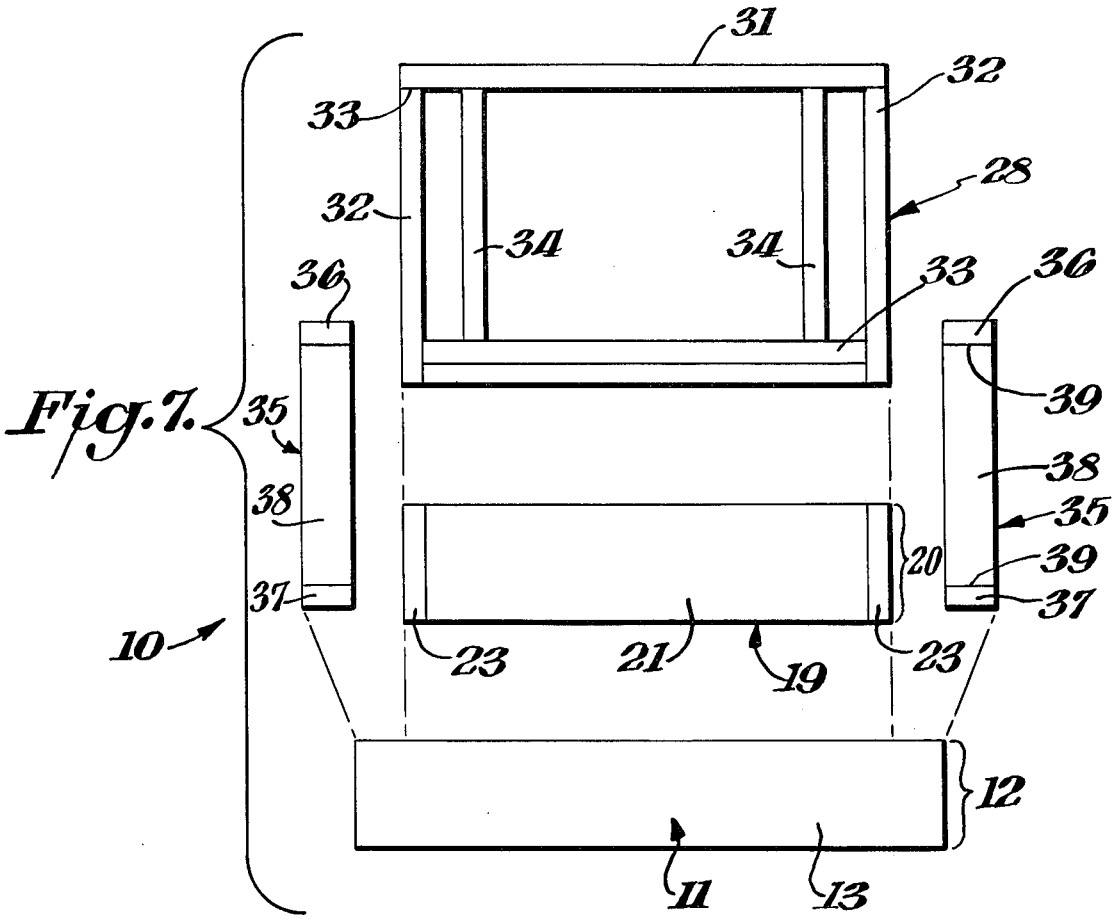
FIG. 7 is an exploded view illustrating the modular components of the chair frame unit of this invention.

Thus, it is apparent that the chair frame unit of this invention can be a single chair having two arm frames 35 or it could be a sofa comprised of two of the chair frame units with each unit having a single arm frame 35 in which case the sides of the units not having the arms would be bolted together while in alignment to provide a unitary, rigid sofa unit. Such an embodiment is illustrated in FIG. 6.

In addition, additional chair frame units of this invention having no arms but rather having the side beams of the base and the seat sectional frame in vertical alignment can be rigidly affixed between end units having a single arm frame.

The units are best fabricated from wood by following conventional cabinet making procedures. All joints should be thoroughly glued and doweled.

For typical furniture of this invention capable of withstanding the wear and tear of institutional use it is desirable to have the single chair units of about 31½ inches in width and 32 inches in depth with a back height of 28½ inches. A typical love seat of this invention would be of a width of about 57½ inches and 32 inches deep with a back height of 28½ inches.

A sofa comprising three of the chair units of this invention is about 83½ inches wide and 32 inches deep with a back height of 28½ inches.

For certain uses it is desirable to have a sofa unit comprised of four of the chair units of this invention in which case the sofa would be 109½ inches in width and 32 inches deep with a back height of 28½ inches.

Using 1⅛ inch wood, such as maple, it is desirable that the multiple units be bolted together with steel machine bolts as illustrated of about 4⅜ inches length and the bases and seat section frame anchored together with steel machine bolts of a length of 3⅜ inches.

The arm frames are typically 32 inches long, 15 inches high, and 3¾ inches in width.

The upholstering of the chair can be done in a conventional manner. Particularly it is desirable to have flat no sag springs running from side-to-side across the top portion of the seat section frame. Such springs are desirably of number nine guage. Five such springs are preferably equally spaced along the seat section frame. It is desirable that seat backs have a rubber webbing material arranged in a lattice formation.

The foundation of the seat and back units is best comprised of a six inch thick latex or high density polyurethane cushioning material.

The chair unit of this invention offers a structure that is particularly desirable for institution use where abuse and high wear are commonplace. In the event that a portion of one of the units is broken or damaged, it can readily be replaced merely by removing the appropriate upholstery material and unbolting the defective portion. In addition, the seat and/or back cushions can readily be replaced in the event of damage.

Although wood is the preferred material of construction for the chair frame unit of this invention other materials such as various plastics or metal could be utilized to achieve a particular end use.

I claim:

1. A chair frame unit adaptable to provide sectional furniture comprising;

a. a base of substantial thickness adapted to support a seat section frame, a back frame, and at least one arm frame, and function as legs to provide high rigidity and strength to the unit, said base comprising a front beam, a rear beam, and two side beams arranged in a rectangular array rigidly connected at each of four corners; said base having lower peripheral edges adapted to engage a supporting surface substantially in their entirety;

b. a seat section frame of substantial thickness arranged and adapted to rest upon the base and rigidly and detachably affixed to the base and further adapted to support seat cushioning means, said seat section comprising a front beam, back beam, and two side beams, at least one of the seat section side beams being disposed inwardly with respect to the base side beam below it in an amount sufficient to allow an arm frame to rest atop the base and be in substantial vertical alignment with the side beam of said base while being arranged adjacent to and against the inwardly disposed seat section side beam;

c. a back frame adapted to receive back cushioning means and further adapted to rest on top of said seat section rear beam with the exterior portions of said back frame being in substantial vertical alignment with the exterior portion of the seat section side beams, said back frame comprising a bottom member, a top member, and two side members rigidly connected to each other at their corners to form a rectangular array, said back frame being rigidly and detachably affixed to the seat section frame and an arm frame; and d. at least one arm frame comprised of a top member, bottom member, and two end members rigidly affixed to each other at corners to provide a rectangular array, said arm frame being adapted and disposed to rest atop the base in substantial vertical alignment with the exterior portion of the side beam of the base located below the arm frame and against the exterior portion of the adjacent side beam of the seat section frame, said arm frame being rigidly and detachably affixed to the seat section frame and the back frame.

2. The chair frame unit as defined in claim 1 having two arm frames in (d).

3. The chair frame unit as defined in claim 1 wherein in (b) the front beam of the seat section frame is located and disposed to extend beyond the front beam of the base located below to provide an overhang.

4. The chair frame unit as defined in claim 1 having one arm frame in (d) and in (b) one of the side beams of the seat section is in substantial vertical alignment with the side beam of the base located below.

5. The chair frame unit as defined in claim 4 wherein the unit is aligned and rigidily and detachably affixed with securing means to another identical unit having the arm frame located on the opposite side to provide a sofa.

* * * * *